US006824255B2

(12) United States Patent
Hino

(10) Patent No.: US 6,824,255 B2
(45) Date of Patent: Nov. 30, 2004

(54) INK JET RECORDING DEVICE

(75) Inventor: Motohito Hino, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 86 days.

(21) Appl. No.: 10/183,483

(22) Filed: Jun. 28, 2002

(65) Prior Publication Data

US 2003/0007041 A1 Jan. 9, 2003

(30) Foreign Application Priority Data

Jul. 3, 2001 (JP) ..... 2001-201954

(51) Int. Cl.[7] ..... B41J 2/175

(52) U.S. Cl. ..... 347/85; 347/86; 347/87; 347/92

(58) Field of Search ..... 347/85, 86, 87, 347/88, 89, 92

*Primary Examiner*—Stephen D. Meier
*Assistant Examiner*—Ly T Tran
(74) *Attorney, Agent, or Firm*—Oliff & Berridge, PLC

(57) ABSTRACT

An ink jet recording device including a head unit and a support member. The head unit includes a head member that ejects ink in a predetermined direction and a head-unit-side connection member formed with a first channel in fluid connection with the head member for supplying ink to the head member. The support member detachably supports the head unit. The support member includes a support-member-side connection member formed with a second channel. While the support member supports the head unit, the support-member-side connection member and the head-unit-side connection member are connected to each other with the second channel and the first channel in fluid communication. Also, the connection members extend in a substantial linear relationship at an angle.

16 Claims, 7 Drawing Sheets

INK JET RECORDING DEVICE

BACKGROUND OF THE INVENTION

1. Field of the Invention

The present invention relates to an ink jet recording device that ejects ink from nozzles to record on sheets and the like.

2. Description of the Related Art

One conventional ink jet recording device includes a head unit with an ink cartridge and an ink jet head. The ink cartridge holds ink and the ink jet head ejects the ink onto a sheet, for example, to record images on the sheet. The ink cartridge and the ink jet head are brought into fluid communication by a tube through which ink flows from the ink cartridge to the ink jet head. This can be referred to as a tube-supply type ink jet recording device.

FIG. 1 shows a conventional tube-supply type ink jet recording device. The device includes a head unit 1, a carriage 20 that supports the head unit 1, a subtank 26, and an ink cartridge 31 for supplying ink to the head unit 1.

The head unit 1 includes a head holder 2, an ink jet head 3, a buffer tank 4, tubes 15, 16, and a head-side joint member 5.

The ink jet head 3 includes an actuator 6 and a manifold 7. The actuator 6 is formed with a plurality of ejection channels (not shown) for ejecting ink from a nozzle surface 8. The manifold 7 is connected to the upper end portion of the actuator 6 and is formed with an upwardly protruding ink-inflow port 10. The manifold 7 distributes ink from the ink-inflow port 10 to each of the ink channels in the actuator 6. The actuator 6 changes volume in the ink channels to eject ink vertically downward from the nozzle surface 8.

The head holder 2 is supported by the carriage 20 with a substantially horizontal orientation. The head holder 2 supports the ink jet head 3 through an attachment plate 11 that is fixedly attached to the manifold 7. The head holder 2 includes a head cover 9 that covers the ink jet head 3 in a condition with the nozzle surface 8 exposed facing vertically downward.

The buffer tank 4 serves as a vessel for temporarily holding ink. The buffer tank 4 is supported by the head holder 2 at a position above the ink jet head 3. The buffer tank 4 is formed at its lower portion with a downwardly protruding ink-outflow port 14, and at its upper side with an upwardly protruding ink-supply port 12 and an upwardly protruding ink-return port 13. The ink-outflow port 14 is connected to the ink-inflow port 10 of the manifold 7. With this configuration, ink held in the buffer tank 4 is supplied from the ink-outflow port 14 to the manifold 7 through the ink-inflow port 10. The ink-supply port 12 is connected to the inner supply tube 15 and the ink-return port 13 is connected to the inner-return tube 16.

The head-side joint member 5 includes a head-side-supply joint 18 and a head-side-return joint 19 that are aligned next to each other on, and that protrude vertically upward from, the head holder 2. The head-side-supply joint 18 and the head-side-return joint 19 are each formed in a hollow-tube shape. The head-side-supply joint 18 and the head-side-return joint 19 are connected at the top end to the inner supply tube 15 and the ink-return port 13, respectively, and are open downward.

The carriage 20 includes a casing 21 and a carriage-side joint member 22. The casing 21 houses the head unit 1 and supports the head unit 1 and the carriage-side joint member 22 with substantially a horizontal orientation. The carriage-side joint member 22 is provided on the casing 21 and includes a carriage-side-supply joint 23 and a carriage-side-return joint 24. The carriage-side-supply joint 23 and the carriage-side-return joint 24 are formed in a hollow-tube shape and protrude vertically upward. The carriage-side-supply joint 23 and the carriage-side-return joint 24 are inserted in the head-side-supply joint 18 and the head-side-return joint 19, respectively, to connect to the head-side-supply joint 18 and head-side-return joint 19.

The carriage-side-supply joint 23 is connected to subtank 26 through an outer-supply tube 27 and the carriage-side-return joint 24 is connected to the subtank 26 through an outer-return tube 28. A circulation pump 29 is provided along the outer-return tube 28.

When the circulation pump 29 is driven, ink held in the subtank 26 is supplied to the buffer tank 4 through the outer-supply tube 27, the carriage-side-supply joint 23, the head-side-supply joint 18, the inner supply tube 15, and the ink-supply port 12. Simultaneously with this, ink held in the buffer tank 4 is returned to the subtank 26 through ink-return port 13, the inner-return tube 16, the head-side-return joint 19, the carriage-side-return joint 24, and the outer-return tube 28. Bubbles generated in the ink are collected in the subtank 26 with the ink, and naturally separate from the ink by the difference between weight of the bubbles and the ink in the subtank 26. The circulation pump 29 is normally not driven. Rather, the amount of ink that is ejected by the ink jet head 3 is naturally supplied from the subtank 26 to the buffer tank 4 through the outer-supply tube 27 by force of capillary action that operates in the nozzle portion of the actuator 6.

The ink cartridge 31 is connected to the subtank 26 through a supplementary tube 30. Also, a liquid-feed pump 32 is provided along the supplementary tube 30. The liquid-feed pump 32 normally supplies ink from the ink cartridge 31 into the subtank 26 in accordance with reduction in the amount of ink held in the subtank 26.

SUMMARY OF THE INVENTION

The head-side-supply joint 18 and the carriage-side-supply joint 23, and the head-side-return joint 19 and the carriage-side-return joint 24, extend in substantially the same direction in which the ink jet head 3 ejects ink, and moreover, are connected in a vertical direction that is substantially perpendicular to the direction in which the head unit 1 is supported on the casing 21. Therefore, the tubes 15 and 16 need to be bent around at an approximately 180° angle in order to connect the tubes 15 and 16 to the joints 18 and 19. For this reason, the tubes 15 and 16 need to be made from an extremely flexible material. This places an inconvenient limitation on materials that can be used to form the tubes 15 and 16.

Also, the tubes 15 and 16 need to be rather long because the distance between connection ends of the tubes 15 and 16 increases when the tubes 15 and 16 are bent around at an approximately 180° angle. As a result, more material is required to produce the tubes 15 and 16, so material costs increase. Also, the amount of ink that needs to be circulated increases. Production costs increase because a more powerful pump is required and running costs increase because the more powerful pump requires more energy to run. Also, because flexible tubes are normally semi permeable to air, a great amount of air penetrates through the walls of the tubes 15 and 16 because the tubes 15 and 16 are so long. More bubbles are generated so the possibility of defective ejections in the ink jet head 3 also increases.

Because the joints 18 and 19 are aligned next to each other on, and protrude vertically upward from, the head holder 2, it is impossible to secure a sufficient pressure head, even though the head-side joint member 5 is supported on the head holder 2 at a position that is higher than the ink jet head 3. Ink can be drip out from the joints 18 and 19 after the joints 23, 24 detach from the joints 18 and 19 when the head unit 1 is detached from the carriage 20.

Because the joints 18 and 23, and the joints 19 and 24, have a substantial vertical orientation when connected to each other, the head holder 2 and the carriage 20 need to be wider by an amount equal to the width of the joints 18, 23, 19, and 24. Therefore, the silhouette of the head unit 1 is larger, so that the ink jet recording device is larger, and manufacture, transport, and storage are less convenient.

It is an objective of the present invention to overcome the above-described problems and provide an ink jet recording device including a head unit that has no limitations on the material of the inner-supply tube and the inner-return tube so that production costs and running costs can be reduced, that has fewer ink drips when the head unit is detached, and further that has a small silhouette.

In order to achieve the above-described objectives, an ink jet recording device according to one aspect of the present invention includes a head unit and a support member. The head unit includes a head member and a head-unit-side connection member. The head member ejects ink in a predetermined direction. The head-unit-side connection member is formed with a first channel in fluid connection with the head member for supplying ink to the head member. The support member detachably supports the head unit and includes a support-member-side connection member formed with a second channel. While the support member supports the head unit, the support-member-side connection member and the head-unit-side connection member are connected to each other with the second channel and the first channel in fluid communication and extend in a substantial linear relationship at an acute angle with respect to the predetermined direction of ink ejection by the head member.

An ink jet recording device according to another aspect of the present invention includes a head unit and a support member. The head unit includes a head member for ejecting ink and a head-unit-side connection member formed with a first channel in fluid connection with the head member for supplying ink to the head member. The support member detachably supports the head unit and includes a support-member-side connection member and a support surface. The support-member-side connection member is formed with a second channel. The support surface extends in a predetermined direction to provide sufficient surface area to support the head unit. While the support member supports the head unit, the support-member-side connection member and the head-unit-side connection member connected to each other with the second channel and the first channel in fluid communication and extend in a substantial linear relationship at an acute angle with respect to the predetermined direction in which the support surface extends.

An ink jet recording head according to one aspect of the present invention includes a head member, an inlet member, and a connection member. The head member ejects ink. The inlet member is provided on the head member and protrudes away from the head member in a predetermined direction. The connection member is for connecting with an external ink source to receive ink from the external ink source. The connection member is in fluid connection with the inlet member and extends in a direction at an acute angle with respect to the predetermined direction in which the inlet member protrudes.

An ink jet recording head according to another aspect of the present invention includes a head member and a connection member. The head member includes a nozzle surface that extends in a predetermined direction. The nozzle surface is formed with nozzles that eject ink. The connection member is for connecting with an external ink source to receive ink from the external ink source. The connection member is in fluid connection with the inlet member and extends in a direction at an acute angle with respect to the predetermined direction in which the nozzle surface extends.

BRIEF DESCRIPTION OF THE DRAWINGS

The above and other objects, features and advantages of the invention will become more apparent from reading the following description of the embodiment taken in connection with the accompanying drawings in which.

DETAILED DESCRIPTION OF THE EMBODIMENT

Next, a tube-supply type ink jet recording device according to an embodiment of the present invention will be described while referring to FIGS. 2 to 8.

Figure 1:
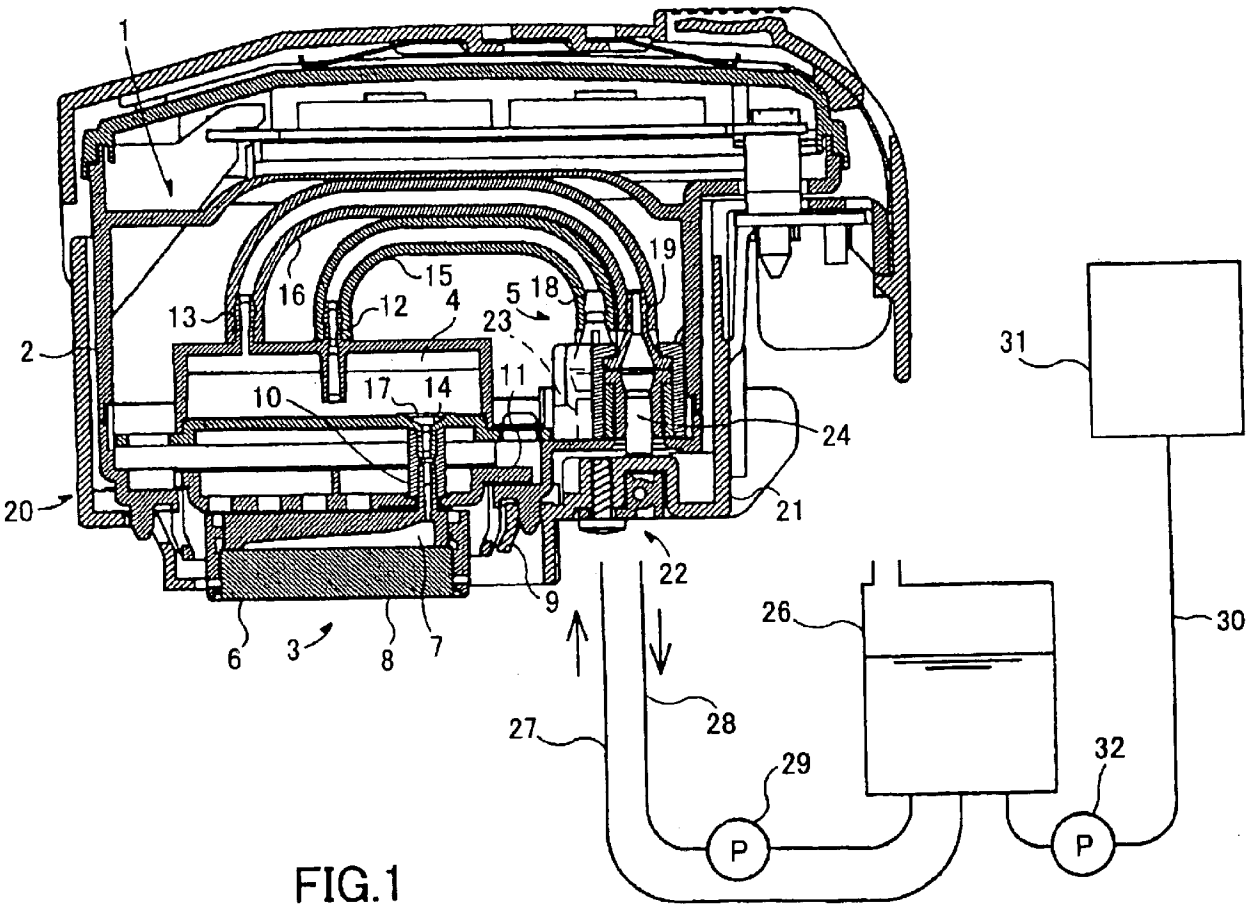
FIG.1 PRIOR ART
FIG. 1 is a cross-sectional view showing a conventional ink jet recording device with a head unit mounted on a carriage.

As shown in FIG. 1, the ink jet recording device includes a head unit 41, a carriage 42, a subtank 43, and an ink cartridge 44.

Figure 3:
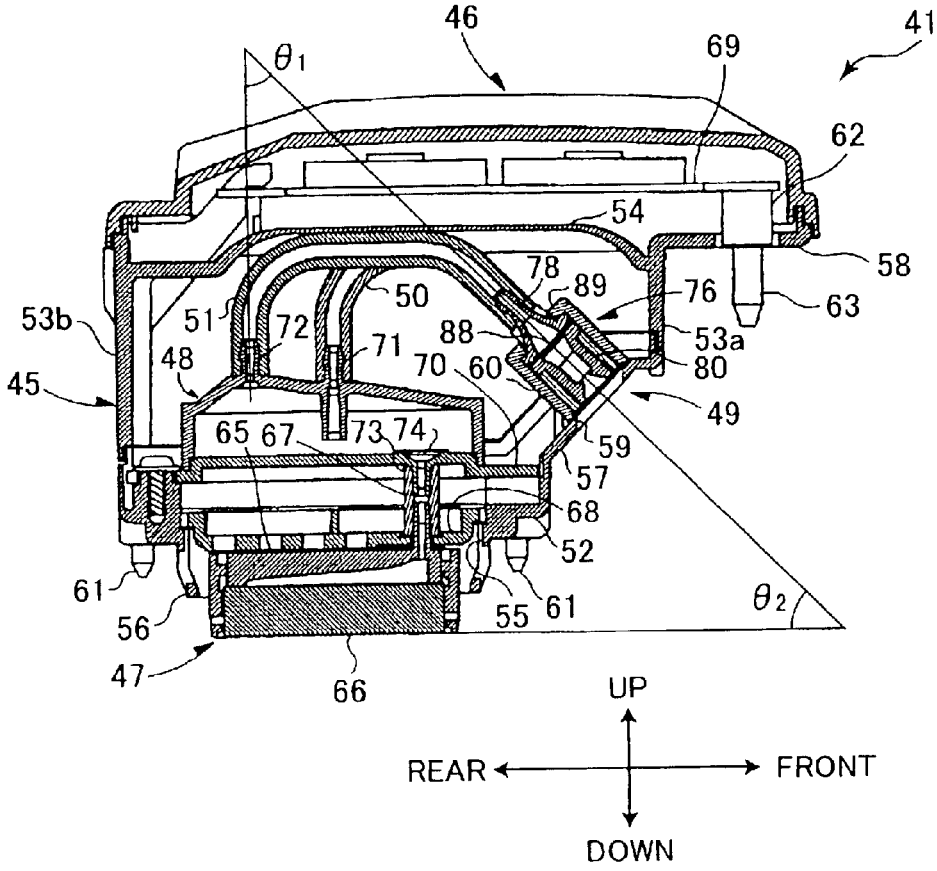
FIG. 3 is a cross-sectional view showing the head unit of FIG. 2.

As shown in FIG. 3, the head unit 41 includes a head holder 45, a head cover 46, an ink jet head 47, a buffer tank 48, a head-side joint member 49, an inner-supply tube 50, and an inner-return tube 51.

The head holder 45 houses the ink jet head 47, the buffer tank 48, the head-side joint member 49, the inner-supply tube 50, and the inner-return tube 51. The head holder 45 includes a base wall 52, four side walls (only a front side wall 53*a* and a rear side wall 53*b* are shown in the drawings), and an upper wall 54. The side walls 53 and the upper wall 54 are formed integrally together in an open box shape with the lower surface opened. The base wall 52 is fixed to lower edges of the side walls 53*a*, 53*b* and is formed with an opening portion 55 through which ink jet head 47 protrudes downward, a cover member 56, and two positioning pins 61. The cover member 56 protrudes further downward from the opening portion 55 and covers the sides of the ink jet head 47. The positioning pins 61 are formed protruding downward from the front and rear sides, that is, the left and right sides as viewed in FIG. 3, of the opening portion 55. Further, a support wall 70 is supported above the base wall 52 so as to extend in a substantially horizontal orientation.

The front side wall 53*a* is formed with a slanting wall 57. The slanting wall 57 is disposed to the front of and vertically higher than the ink jet head 47 and tilts slantingly upward. The slanting wall 57 is formed with a head-side joint insertion hole 59 through which a carriage-side joint member 117 of the carriage 42 is inserted. A joint support member 60 is fixed by a fixing member (not shown) to the inner surface of the slanting wall 57 so as to surround the head-side joint insertion hole 59. An engagement portion 89 that fixes the head-side joint member 49 in place is formed on the upper wall of the joint support member 60. The upper wall 54 is formed with a connector insertion plate 58 that protrudes substantially horizontally toward the front.

The head cover 46 is attached to, covers, and extends substantially in parallel with, the upper wall 54 of the head holder 45. A head board 69 for driving deformation of an actuator 64 of the ink jet head 47 is supported inside the head cover 46. A head-side connector 62 is formed at the front end of the head board 69. The head-side connector 62 is for electrically connecting the head board 69 with a carriage-side connector 123 to be described later, and protrudes downward and is exposed through a through hole in the connector insertion plate 58 for this purpose. Also, connector positioning pins 63 are provided on left and right sides of the head-side connector 62.

The ink jet head 47 includes the actuator 64 and a manifold 65. The head unit 1 ejects ink downward as indicated by an arrow Z in FIG. 2. The actuator 64 is connected to the head board 69 through a flexible wiring substrate (not shown). The actuator 64 has a substantially rectangular shape and is made from a material, such as a piezoelectric ceramic material, that can be driven to deform by application of voltage from the head board 69. The actuator 64 includes a plurality of ink channels (not shown) and a nozzle surface 66. The nozzle surface 66 is formed with nozzles that are in fluid communication with the ink channels in the actuator 64. The manifold 65 is connected to the upper portion of the actuator 64. The manifold 65 is formed with an upwardly protruding ink inflow port 67 and distributes ink from the ink inflow port 67 to the ejection channels of the actuator 64. When the head board 69 applies an ejection pulse signal to the actuator 64, the actuator 64 changes volume of the ink channels accordingly. As a result, ink supplied to the ink channels from the manifold 65 is ejected from the nozzles substantially vertically downward as ink droplets to form predetermined characters on a sheet, for example.

An attachment plate 68 is engaged in the inner peripheral edge of the opening portion 55 in the base wall 52 and is fixedly adhered to the upper end of the manifold 65. The attachment plate 68 supports the ink jet head 47 by its adhesion connection with the manifold 65 so that the ink jet head 47 protrudes downward through the base wall 52 of the head holder 45 and so that the nozzle surface 66 of the actuator 64 faces substantially vertically downward, exposed from the opening portion 55 of the base wall 52. The attachment plate 68 supports the ink jet head 47 so that the nozzle surface is maintained in a predetermined orientation, that is, horizontal in this example.

The buffer tank 48 is a vessel that temporarily holds ink to be supplied to the ink jet head 47. The buffer tank 48 is supported on the support wall 70 of the head holder 45 at a position above the ink jet head 47. The upper surface of the buffer tank 48 is formed with an ink-supply port 71 and an ink-return port 72. The ink-supply port 71 and the ink-return port 72 both protrude upward in the same vertical direction. The ink-supply port 71 is connected to one end of the inner-supply tube 50 and the ink-return port 72 is connected to one end of the inner-return tube 51. The support wall 70, which is also serves as the lower surface of the buffer tank 48, is formed with a downward protruding ink outflow port 73. The ink outflow port 73 is provided with a filter 74 and is also in fluid communication with the ink inflow port 67 of the manifold 65. The ink held in the buffer tank 48 is supplied from the ink outflow port 73 to the manifold 65 through the filter 74.

The head-side joint member 49 includes a head-side supply joint 75 and a head-side return joint 76, which are positioned in the joint support member 60 on the slanting wall 57 and aligned in a direction that extends perpendicular to the surface of the sheet of paper on which FIG. 3 is drawn.

Figure 4:
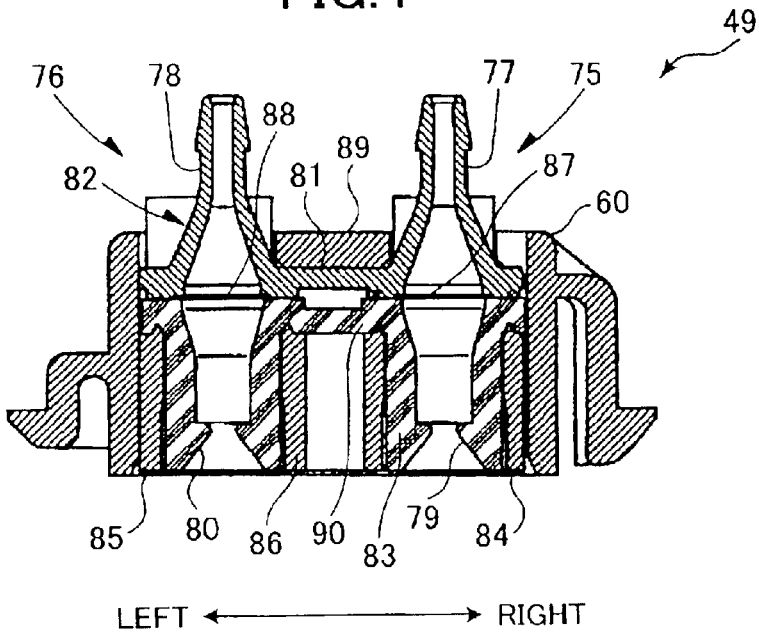
FIG. 4 is a cross-sectional view showing head-side joint members of the head unit.

As shown in FIG. 4, the head-side joint member 49 includes an inner member 82, an outer member 83, an outer pressing member 86, and two filter members 87, 88. The inner member 82 is made from resin and includes a connection member 81 integrally connected to an inner-side connection portion 77 of the head-side supply joint 75 and an inner-side connection member 78 of the head-side return joint 76. The outer member 83 is made from rubber and includes a connection member 90 integrally connected to an outer-side connection member 79 of the head-side supply joint 75 and an outer-side connection member 80 of the head-side return joint 76. The outer pressing member 86 is made from resin and defines two tube portions 84, 85 in which the outer-side connection members 79 and 80 are inserted. The filter members 87, 88 are interposed between the inner-side connection portion 77 and the outer-side connection member 79, and between the inner-side connection member 78 and the outer-side connection members 80, respectively.

The head-side joint member 49 is assembled in the following manner. First, the inner member 82 is inserted into the joint support member 60 until the connection member 81 abuts against the engagement portion 89 of the joint support member 60. Then, the filter members 87, 88 are disposed in the opening portion of the inner-side connection portions 77 and 78 and fixed supersonically, thermally, or by other method to the opening portions of the inner-side connection portions 77 and 78, respectively. Next, the outer member 83 is inserted into the joint support member 60 with the outer-side connection members 79 and 80 lined up with the inner-side connection portions 77 and 78, respectively. Then, the outer pressing member 86 is inserted into the joint support member 60 so that the outer-side connection members 79 and 80 are inserted into the tube portions 84, 85; respectively.

As shown in FIG. 3, the head-side joint member 49 is oriented substantially perpendicular to the slanting wall 57 so that the head-side joint member 49 extends with an upward slant to the rear, which is the direction of the ink jet head 47 from the head-side joint member 49. The head-side joint member 49 is oriented so that channels in the joints 75, 76 are oriented at an acute angle $\theta_1$ with respect to the direction in which the ink-supply port 71 and the ink-return port 72 extend, that is, vertically upward, and also at an acute angle $\theta_2$ with respect to the predetermined orientation (horizontal) of the nozzle surface 66. The other ends of the inner-supply tube 50 and inner-return tube 51 are connected to the inner-side connection portions 77 and 78, respectively, of the head-side supply joint 75 and the head-side return joint 76.

Figure 5:
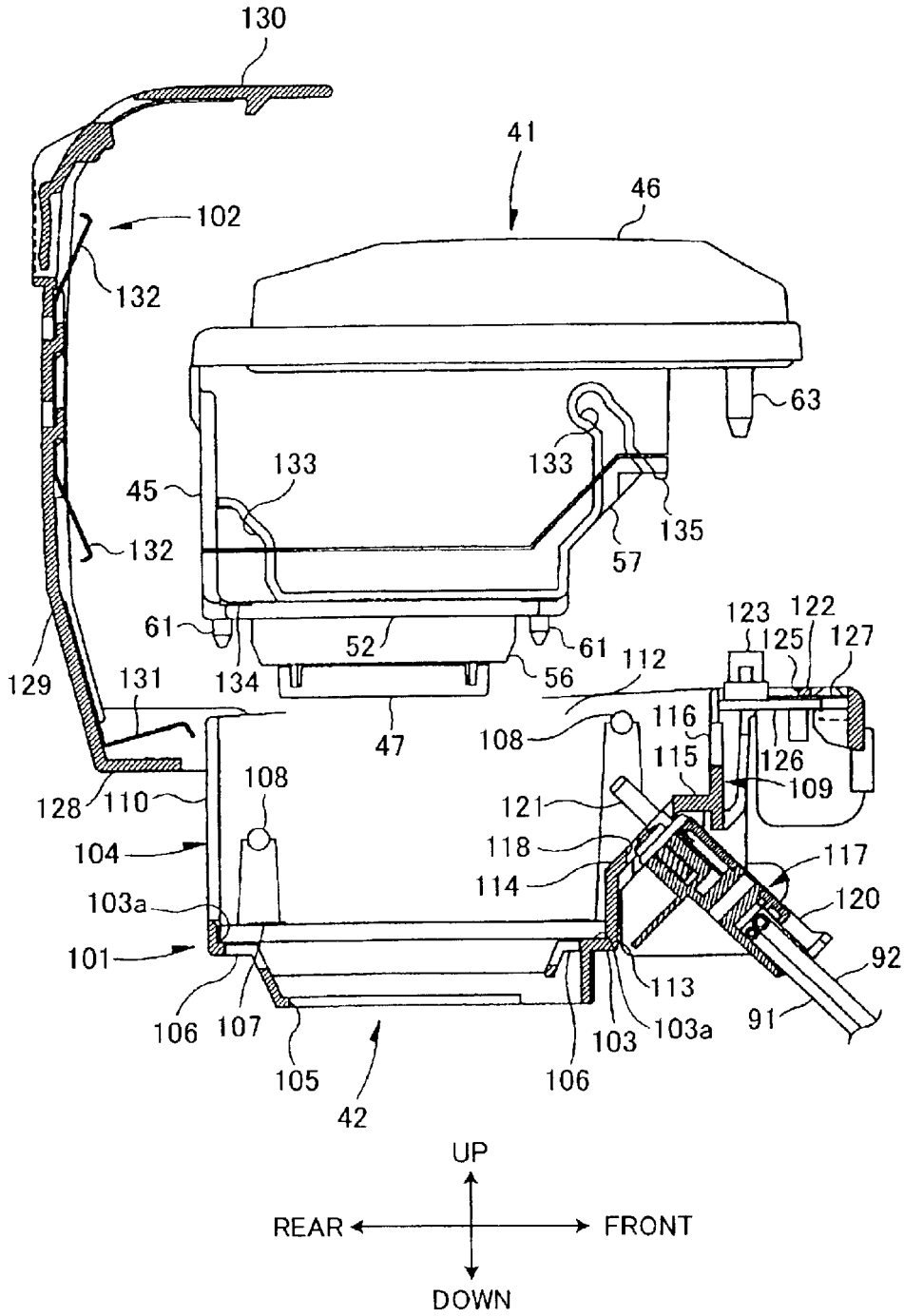
FIG. 5 is a cross-sectional view showing the head unit in the process of being mounted on the carriage.

As shown in FIG. 5, the head unit 41 is configured to be detachably mounted to the carriage 42. Because the head-side joint member 49 has the slanted orientation described above, diagonally-slanting joint tubes 121 of the carriage-side joint member 117 can be inserted into the outer-side connection members 79 and 80 of the head-side supply joint 75 and the head-side return joint 76.

The carriage 42 includes a casing 101 and a lever member 102. The casing 101 is for receiving the head unit 41 and the lever member 102 is for holding the head unit 41 in the casing 101.

Figure 2:
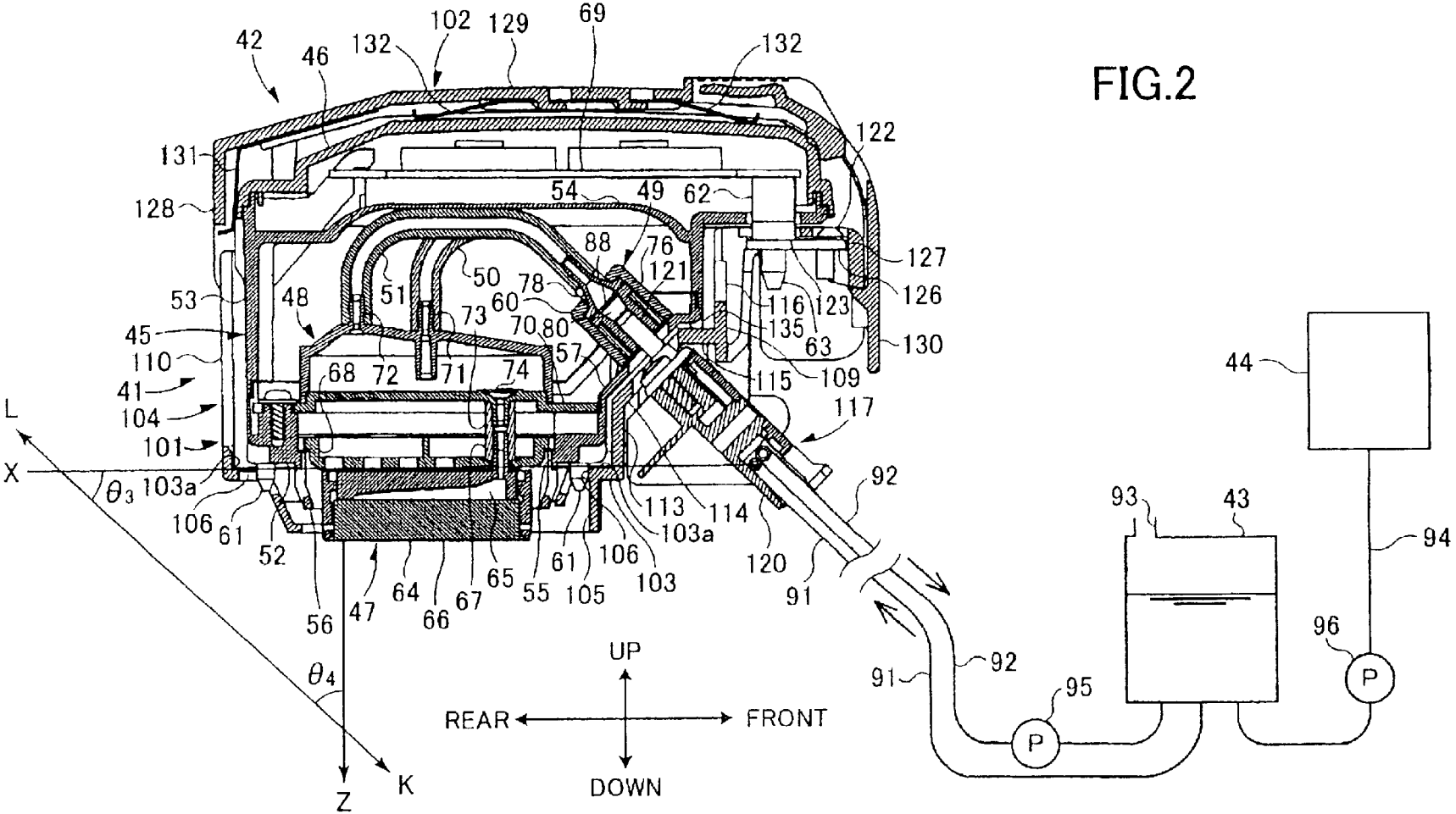
FIG. 2 is a cross-sectional view showing an ink jet recording device according to an embodiment of the present invention, wherein a head unit is mounted on a carriage.
Figure 6:
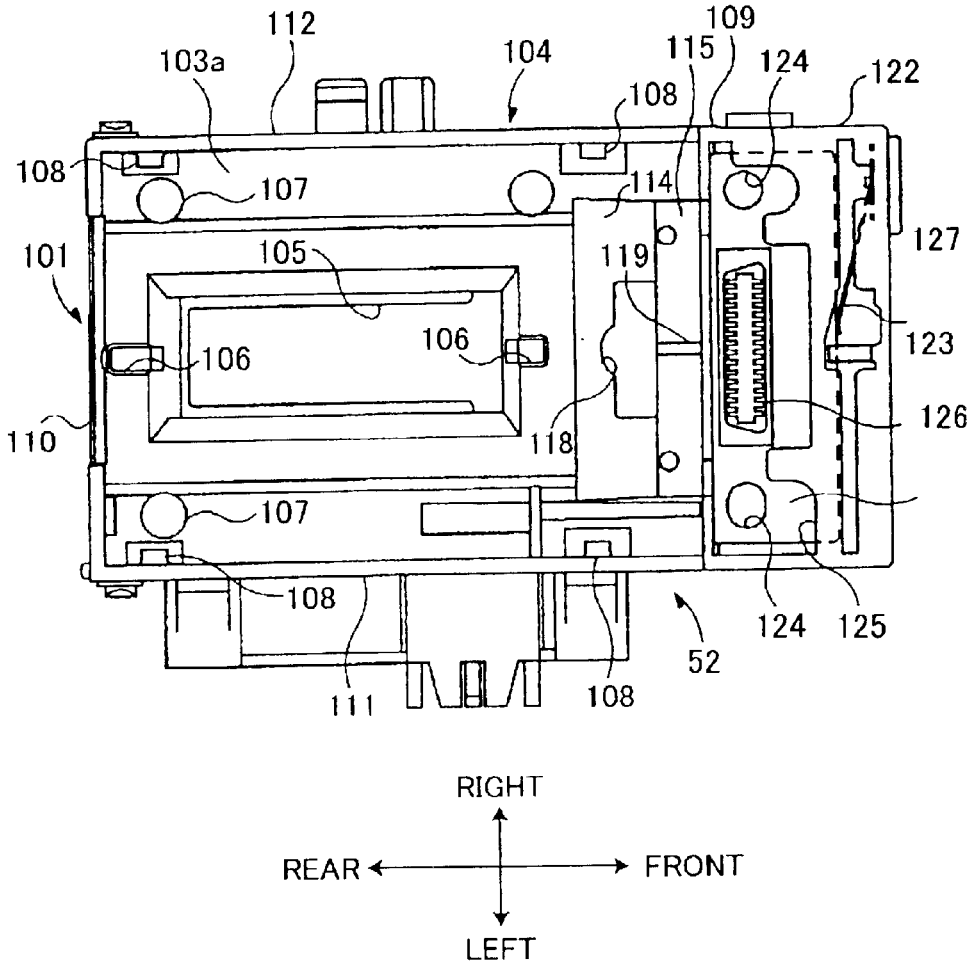
FIG. 6 is a plan view showing the carriage.

The casing 101 includes a bottom wall 103 and side walls 104 integrally formed together in a box shape with an open upper side. As shown in FIG. 6, the bottom wall 103 includes a support surface 103*a* and is formed with a rectangular opening 105, two pin insertion holes 106, and cylindrical protrusions 107. As shown in FIG. 2, the support surface 103*a* extends in the horizontal direction X in order to secure sufficient surface area to support the head unit 41. Returning to FIG. 6, the opening 105 exposes the lower end of the ink jet head 47 of the head unit 41. The pin insertion holes 106 are opened to the front and rear of the opening 105. The positioning pins 61 are inserted into the pin insertion holes 106 as will be described later. The cylindrical protrusions 107 are provided at corner portions around the opening 105.

The side walls 104 include integrally formed walls 109 to 112. The front wall 109 and the rear wall 110 are at the front and rear sides, receptively, and the right wall 111 and the left wall 112 are in the right and left sides, respectively, of the casing 101. Four guide protrusions 108 are formed on the right and left walls 111, 112, that is, two guide protrusions 108 are formed on each of the right and left walls 111, 112. The guide protrusions 108 that are formed on the same one of the walls 111, 112 are separated by a predetermined space in the front-to-rear direction.

As shown in FIG. 5, the front wall 109 includes a lower-side vertical wall 113, a slanting support wall 114, a lower-side horizontal wall 115, an upper-side vertical wall 116, and an upper-side horizontal wall 122. The lower-side vertical wall 113 extends upward substantially in the vertical direction from the bottom wall 103. The slanting support wall 114 extends diagonally upward and forward from the lower-side vertical wall 113. The angle of the slanting support wall 114 follows the angle of the slanting wall 57 of the head holder 45, so that the slanting support wall 114 and the slanting wall 57 confront each other, and extend substantially parallel to each other, when the head unit 41 is completely mounted into the casing 101 as will be described later. The lower-side horizontal wall 115 extends substantially horizontally forward from the slanting support wall 114. The upper-side vertical wall 116 extends substantially vertically upward from the lower-side horizontal wall 115. The upper-side horizontal wall 122 extends substantially horizontally forward from the upper-side vertical wall 116.

The slanting support wall 114 is formed with a carriage-side joint insertion hole 118 through which a carriage-side joint member 117 is inserted. Also, as shown in FIG. 6, a positioning protrusion portion 119 is formed in the substantial widthwise center of the lower-side horizontal wall 115, extending so as to follow the front-to-rear direction.

As shown in FIG. 5, the carriage-side joint member 117 is formed at its lower end with an insertion connection portion 120 and at its upper end with the two joint tubes 121. The insertion connection portion 120 is inserted with and connected to an outer-supply tube 91 and an outer-return tube 92, which, as shown in FIG. 2, are connected to the subtank 43. The joint tubes 121 are for connecting to the outer-side connection members 79 and 80 of the head-side supply joint 75 and the head-side return joint 76. It should be noted that, although not visible in the view of FIG. 5, the insertion connection portion 120 and the joint tubes 121 are aligned in the right-left direction, which is the direction perpendicular to the surface of the sheet on which FIG. 5 is drawn, in the same manner as the outer-side connection members 79 and 80. As a result, the insertion connection portion 120 and the joint tubes 121 confront the outer-side connection members 79 and 80 when the head unit 41 is completely mounted into the casing 101 as will be described later.

The carriage-side joint member 117 is supported at the underside surface of the slanting support wall 114 in an orientation that is substantially perpendicular to the slanting support wall 114. Said differently, the carriage-side joint member 117 is supported at an acute angle in the same slanting direction as the head-side joint member 49. One end of the outer-supply tube 91 and the outer-return tube 92 is insertedly connected with the insertion connection portion 120.

With this configuration, the joint tubes 121 of the carriage-side joint member 117 protrude through the carriage-side joint insertion hole 118 of the slanting support wall 114 into the casing 101 in a slanting orientation that is in the same direction as the slanting direction of the head-side joint member 49.

Figure 7:
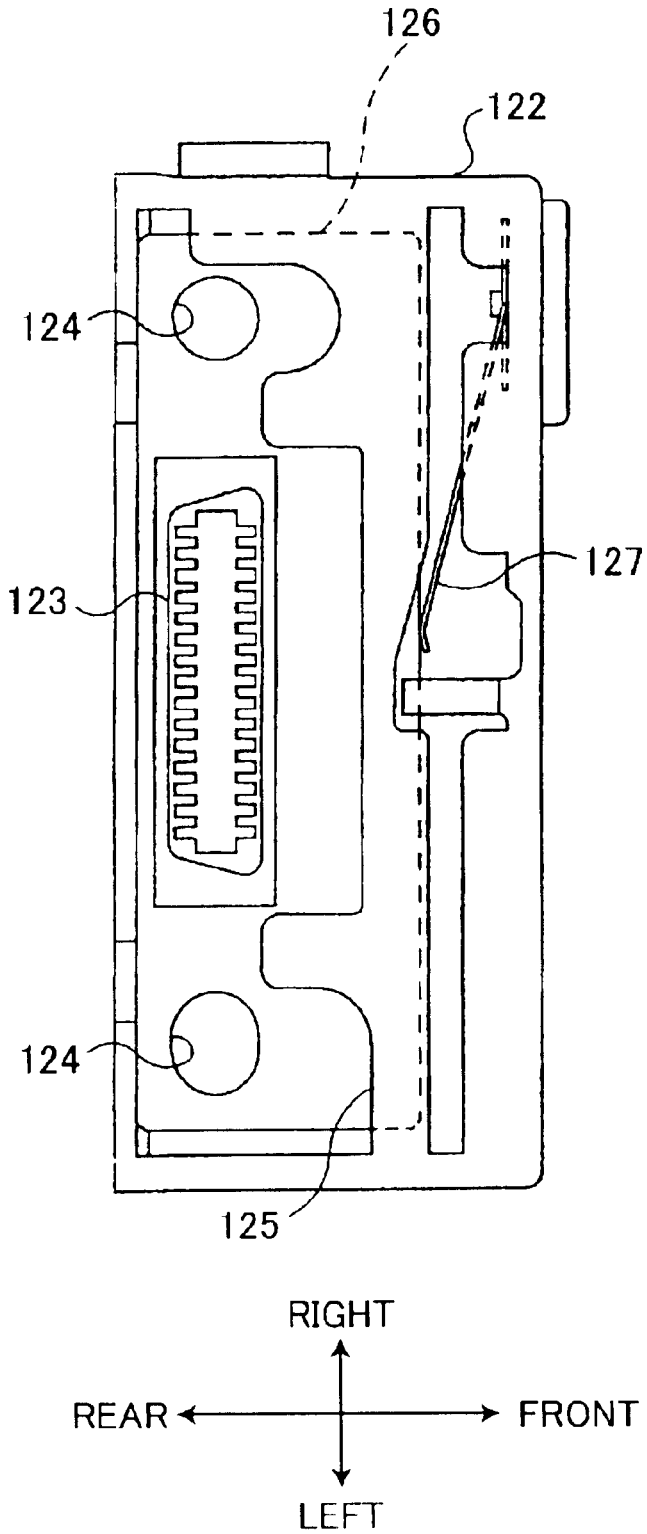
FIG. 7 is a plan view showing essential portions of the carriage before the head is mounted.
Figure 8:
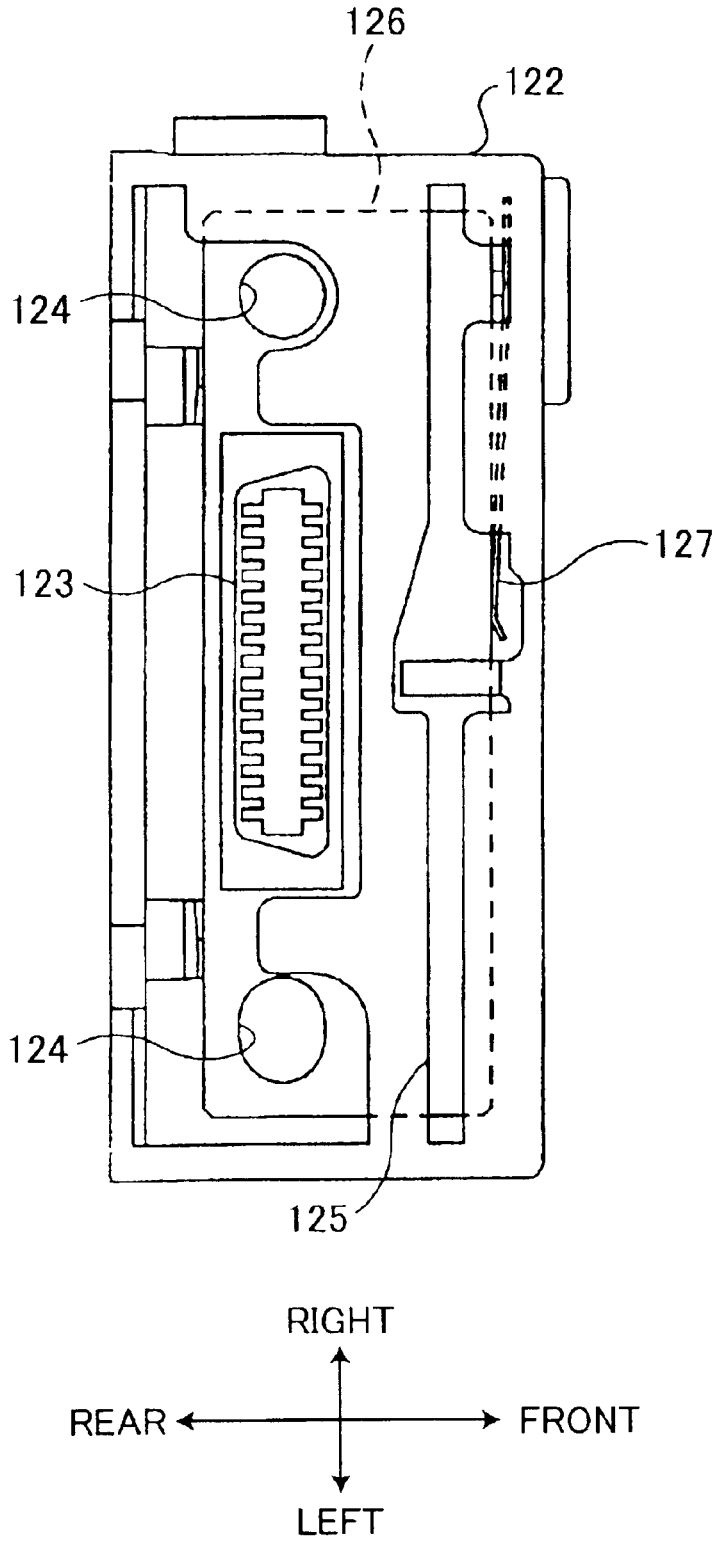
FIG. 8 is a plan view showing essential portions of the carriage after the head is mounted.

As shown in FIG. 5, a slide member 126 and a plate spring 127 are supported on the casing 101 at the underside surface of the upper-side horizontal wall 122. As shown in FIG. 7, the slide member 126 has a substantially rectangular shape and is formed integrally with the carriage-side connector 123 and pin receiving holes 124. The carriage-side connector 123 is for connecting with the head-side connector 62 and is formed with an upwardly protruding posture at the rear center of the upper surface of the slide member 126. It should be noted that the carriage-side connector 123 is connected to a control board (not shown) of the ink jet recording device through a flexible power line (not shown) and a signal line (not shown). The pin receiving holes 124 are formed in the slide member 126 on either side of the carriage-side connector 123 with respect to the left-right direction. The upper-side horizontal wall 122 has a substantially rectangular shape when viewed in plan and is formed with a slide opening 125. The slide opening 125 exposes from above the carriage-side connector 123 and pin receiving holes 124 of the slide member 126. The slide opening 125 is formed to enable the carriage-side connector 123 and the pin receiving holes 124 to slide freely therein in the front-to-rear direction.

The slide member 126 is supported by the casing 101 so as to be freely slidably movable in the front-to-rear direction while exposed from above through the slide opening 125 of the upper-side horizontal wall 122. The plate spring 127 is provided to the front side of the slide member 126. The plate spring 127 is supported by the casing 101 at a location in front of the slide member 126 in constant pressing contact with the rearward end of the slide member 126.

As shown in FIG. 5, the lever member 102 has a substantial C shape in cross section and includes a rear wall 128, an upper wall 129, and a front wall 130. The rear wall 128 is pivotably attached at its lower end by a hinge (not shown) to the rear wall 110 of the casing 101 so that the open upper side of the casing 101 can be selectively covered and closed by the lever member 102. A rear-portion pressing spring 131 for pressing the head holder 45 forward is provided to the inner surface of the rear wall 128 of the lever member 102. Also, an upper-portion pressing spring 132 for pressing the head cover 46 downward is provided at the inner surface of the upper wall 129.

Guide grooves 133 are formed on the outer surfaces of the left and right side walls 53 of the head holder 45. The guide grooves 133 serve to receive the guide protrusions 108 of the casing 101. The guide grooves 133 are separated from each other in the front-to-rear direction by the predetermined distance that separates the guide protrusions 108. Protrusions 134 are formed on the base wall 52 of the head holder 45 at positions that confront the protrusions 107 so as to be capable of abutting against the protrusions 107 by abutting the casing 101. It should be noted that the guide grooves 133 formed in the right and left side walls 53 are formed in a groove shape that extends following diagonally upward and back and are formed so as to guide the head unit 41 in the acute angle direction of the carriage-side joint member 117 and the head-side joint member 49 when the head unit 41 is detached from the carriage 42.

A downward-protruding protrusion 135 is formed on the front side wall 53 at a position directly above the slanting wall slanting wall 57 capable of abutment with the positioning protrusion portion 119, which is formed on the lower-side horizontal wall 115 of the casing 101.

Next, operations for attaching the head unit 41 to and detaching the head unit 41 from the carriage 42 will be described. As shown in FIG. 5, the head unit 41 is first positioned above the carriage 42 before the head unit 41 is mounted in the carriage 42. Then, the head unit 41 is moved substantially vertically downward into the casing 101 until the pin receiving holes 124 of the casing 101 receive the connector positioning pins 63 of the head cover 46 and the guide grooves 133 receive the guide protrusions 108, and until the connector 62 confronts and contacts the connector 123.

When the head unit 41 is inserted further downward into the casing 101, the head unit 41 moves diagonally forward and downward as the guide protrusions 108 follow the shape of the guide grooves 133. Because this downward and forward slanting movement is the same as the upward and rearward angle at which the joint tubes 121 protrude from the slanting support wall 114 of the casing 101, the joint tubes 121 are smoothly insertedly connected in the outer-side connection members 79 and 80 of the head-side joint member 49 of the head unit 41 as shown in FIG. 2.

The connector positioning pins 63 also move forward in association with the forward and downward movement of the head unit 41. Because the connector positioning pins 63 are engaged in the pin receiving holes 124 of the slide member 126, as the connector positioning pins 63 move forward the slide member 126 moves horizontally forward against the urging force of the plate spring 127 from the position shown in FIG. 7 to the position shown in FIG. 8 and the head-side connector 62 and the carriage-side connector 123 connect with each other as shown in FIG. 2.

As shown in FIG. 2, at this time the positioning pins 61 provided on the base wall 52 of the head holder 45 pass through the pin insertion holes 106 formed in the bottom wall 103 of the casing 101. Also at this time, the protrusions 134 of the head holder 45 abut against the protrusions 107 of the casing 101 and the protrusion 135 of the head holder 45 abuts against the positioning protrusion portion 119 of the casing 101. As a result, the head unit 41 is accurately mounted on the carriage 42.

As a result, when the head unit 41 is mounted on the carriage 42, the head-side joint member 49 is smoothly connected with the carriage-side joint member 117 by moving in an acute angle. Moreover, the head-side connector 62 can connect with the carriage-side connector 123 by vertical movement because the horizontal component of the acute angle movement of the head unit 41 is absorbed in the horizontal movement of the slide member 126. Therefore, both connection operations can be performed in a single movement.

Afterward, the lever member 102 is pivoted to cover the head cover 46 as shown in FIG. 2. At this time, the rear-portion pressing spring 131 of the lever member 102 presses the head unit 41 forward and the upper-portion pressing spring 132 presses the head unit 41 downward so that the head unit 41 is securely held on the carriage 42. and the head unit 41 can be supported in a substantially horizontal orientation in the carriage 42. It should be noted that the pivoting movement of the lever member 102 can be used to mount the head unit 41 to the carriage 42.

The operations for removing the head unit 41 from the carriage 42 are the opposite of those for mounting the head unit 41 on the carriage 42. That is, first the lever member 102 is pivoted to open the upper surface of the head cover 46. Then, the head unit 41 is pulled off from the carriage 42. As a result, the guide protrusions 108 are guided by the guide grooves 133 so that the head unit 41 moves diagonally upward to the rear. Therefore, the outer-side connection members 79 and 80 are detached from the joint tubes 121 following the acute angle. Also, the head-side connector 62 disengages from the carriage-side connector 123 while the pressing force of the plate spring 127 moves the slide member 126 horizontally rearward. After the guide protrusions 108 disengage from the guide grooves 133, the head unit 41 is pulled out from the casing 101 substantially vertically upward so that the connector positioning pins 63 are detached from the pin receiving holes 124.

In the same way as when the head unit 41 is mounted on the carriage 42, when the head unit 41 is detached from the carriage 42, both the detachment of head-side joint member 49 from the carriage-side joint member 117 in an acute angle and the detachment of the head-side connector 62 from the carriage-side connector 123 in a vertical direction can be performed in a single smooth movement and the head unit 41 can be reliably detached from the carriage 42. Accordingly, the configuration of the head unit 41 and the carriage 42 facilitates both attachment and detachment operations.

When the head unit 41 is mounted and supported substantially in a horizontal posture on the carriage 42, as shown in FIG. 2, the outer-supply tube 91 is connected to the inner-supply tube 50 through the carriage-side joint member 117 and the head-side supply joint 75 of the head-side joint member 49, and the head-side joint member 49 and the carriage-side joint member 117 are connected to each other with a slanting posture. Also, the outer-return tube 92 is connected to the inner-return tube 51 through the carriage-side joint member 117 and the head-side return joint 76 of the head-side joint member 49. The head-side joint member 49 and the carriage-side joint member 117 are connected to each other with a slanting posture. Therefore, by merely inserting the joint tubes 121 of the carriage-side joint member 117 into the outer-side connection members 79 and 80 of the head-side joint member 49, the outer-supply tube 91 can be reliably connected to the inner-supply tube 50 and the outer-return tube 92 can be reliably connected to the inner-return tube 51.

Also, the head board 69 is connected to a control board of the printer through the head-side connector 62 and the carriage-side connector 123.

While the head unit 41 is housed in the casing 101, the carriage 42 can move the head unit 41 between a recording area and a maintenance area (not shown). The recording area is the range of movement of the carriage 42 where the head unit 41 records images on sheets. The maintenance area is the range of movement of the carriage 42 where maintenance or recovery operations, such as suction or purge operations, are performed on the head unit 41. That is, when printing is performed, the carriage 42 moves the head unit 41 to the recording area and the ink jet head 47 is controlled to eject ink onto sheets to print images. On the other hand, while printing is not being performed, the carriage 42 moves the head unit 41 to the maintenance area. Then, either a cap (not shown) covers the nozzle surface 66 of the ink jet head 47 and the ink jet head 47 waits for the next printing operation or the ink jet head 47 is brought into confrontation with a purge device or a wiping device to perform a recovery operation on the ink jet head 47.

Because the carriage 42 supports the head unit 41 while moving in a direction substantially perpendicular to the ejection direction of the ink jet head 47, proper printing can be performed with a reliable movement operation.

The head unit 41 and the subtank 43 are connected by an outer-supply tube 91 and an outer-return tube 92. In order to induce a negative backpressure at the nozzle surface 66 of the actuator 64, the subtank 43 is located at a position lower than the nozzle surface 66, the other ends of the outer-supply tube 91 and the outer-return tube 92 are connected to the lower wall of the subtank 43, and an atmosphere opening 93 is opened in the upper surface of the subtank 43. Also, the ink cartridge 44 is connected to the subtank 43 through a supplementation tube 94. It should be noted that a circulation pump 95 is provided along the outer-return tube 92 and a feed pump 96 is provided along a supplementation tube 94.

The circulation pump 95 is driven to supply ink from the subtank 43 to the buffer tank 48 through the outer-supply tube 91, the carriage-side joint member 117, the head-side supply joint 75 of the head-side joint member 49, and the inner-supply tube 50. Simultaneously, ink held in the buffer tank 48 returns to the subtank 43 through the inner-return tube 51, the head-side return joint 76 of the head-side joint member 49, and the carriage-side joint member 117. As a result, bubbles generated in the ink are collected in the subtank 43 along with the ink, where they naturally separate from the ink by the difference in weight between the bubbles and the ink in the subtank 43. Normally, the circulation pump 95 is stopped and only the amount of ink that is ejected by the ink jet head 47 is naturally supplied from the subtank 43 to the buffer tank 48 through the outer-supply tube 91 by force of capillary action that operates in the nozzle portion of the actuator 64. When the amount of ink held in the subtank 43 is reduced by ejection of ink from the ink jet head 47, the feed pump 96 is driven to supplement the ink in the subtank 43 from the ink cartridge 44.

When the head unit 41 is properly mounted on the carriage 42 as described above, then as shown in FIG. 2 the carriage-side joint member 117 and the head-side joint member 49 are connected together so as to extend in a substantial linear relationship in directions K, L at an acute angle $\theta_3$ with respect to the horizontal direction X in which the support surfaces 103*a* extend and at acute angle $\theta_4$ with respect to the vertical direction Z in which ink is ejected. The outer-supply tube 91 and the outer-return tube 92 are connected together, and the inner-supply tube 50 and the inner-return tube 51 are connected together, at this slanting posture.

This contrasts with the configuration shown in FIG. 1, wherein the outer-supply tube 27 and the outer-return tube 28, and the inner-supply tube 15 and the inner-return tube 16, are connected by the carriage-side joint member 22 and the head-side joint member 5 oriented in the same direction in which ink is ejected, that is, in the direction that is substantially perpendicular to the direction in which the carriage 20 supports the head unit 1.

The inner-supply tube 50 connected between the ink-supply port 71 of the buffer tank 48 and the head-side supply joint 75 only needs to bend by an angle of about 135°, which is a smaller angle than the configuration in FIG. 1. Similarly, the inner-return tube 51 connected between the ink-return port 72 of the buffer tank 48 and the head-side return joint 76 only needs to bend by an angle of about 135°, which is a smaller angle than the configuration in FIG. 1. For this reason, the inner-supply tube 50 and the inner-return tube 51 need not be formed with an extremely flexible material, so the range of materials that can be selected from for making the inner-supply tube 50 and the inner-return tube 51 can be greatly increased.

Because the outer-supply tube 91 and the outer-return tube 92, and the inner-supply tube 50 and the inner-return tube 51, are connected at an acute angle, the distance from where the inner-supply tube 50 and the inner-return tube 51 connect with the buffer tank 48 to where they connect to the head-side supply joint 75 is shorter than the configuration in FIG. 1, where the connection is made in the same direction as the direction that ink is ejected. For this reason, material costs for the inner-supply tube 50 and the inner-return tube 51 can be reduced. Also, the amount of ink circulated can be reduced so that running costs and maintenance costs can be reduced.

Because the head-side joint member 49 and the carriage-side joint member 117 are connected at a location that is higher than the location of the ink jet head 47, in particular because the head-side joint member 49 is higher, a sufficiently high pressure head can be secured in the ink jet head 47. Further, because the head-side supply joint 75 and the head-side return joint 76 are disposed in a slanting posture that slants towards the ink jet head 47, an even higher pressure head can be secured. For this reason, when the head unit 41 is detached from the carriage 42 so that the outer-supply tube 91 and the outer-return tube 92 are detached from the head-side supply joint 75 and the outer-side connection members 79 and 80 of the head-side return joint 76, ink will seldom leak out from the outer-side connection members 79 and 80 so that maintenance of the head unit 41 can be performed without problem.

Because the slanting wall 57 on which the head-side joint member 49 and the carriage-side joint member 117 are connected slants at an angle upward and forward in a direction that is substantially perpendicular to the slanting direction of the head-side joint member 49, the horizontal width at the front side of the head unit 41 is reduced so that the silhouette of the head unit 41 can be made that much smaller. The silhouette of the casing 101 can also be made smaller because the slanting support wall 114 of the carriage 42 is formed to follow the slanting wall 57. Therefore, the ink jet recording device can be made that much more compact and light weight. Also, design, packaging, and distribution costs can be reduced. Manufacture, transport, and storage of the ink jet recording device is more convenient.

While the invention has been described in detail with reference to specific embodiments thereof, it would be apparent to those skilled in the art that various changes and modifications may be made therein without departing from the spirit of the invention, the scope of which is defined by the attached claims.

For example, although embodiment describes the actuator 64 as being made from piezoelectric ceramics, a different type of electromechanical displacement conversion means can be used. Alternatively, a thermal ink jet type actuator can be used. A thermal ink jet type actuator ejects ink by bubbles generated by local heating of ink.

Also, the embodiment describes that the configuration for ink supply also circulates ink and includes a buffer tank. However, the ink supply configuration need not circulate ink and also need not include a buffer tank.

What is claimed is:

1. An ink jet recording device comprising:

a head unit including:

a head member that ejects ink in a predetermined direction; and a head-unit-side connection member formed with a first channel in fluid connection with the head member for supplying ink to the head member; and a support member that detachably supports the head unit, the support member including a support-member-side connection member formed with a second channel, wherein, while the support member supports the head unit, the support-member-side connection member and the head-unit-side connection member are connected to each other with the second channel and the first channel in fluid communication and extend in a substantial linear relationship at an acute angle with respect to the predetermined direction of ink ejection by the head member.

2. An ink jet recording device as claimed in claim 1, wherein one of the support-member-side connection member and the head-unit-side connection member includes a male member that protrudes in the acute angle and the other of the support-member-side connection member and the head-unit-side connection member includes a female member opened in the acute angle.

3. An ink jet recording device as claimed in claim 1, wherein the support member is a carriage that moves in a direction substantially perpendicular to the predetermined direction of ink ejection by the head member.

4. An ink jet recording device as claimed in claim 1, wherein the support-member-side connection member and the head-unit-side connection member connect to each other at a location that is higher than the location of the head member.

5. An ink jet recording device as claimed in claim 1, wherein at least one of the head unit and the support member further includes a support plate that supports a corresponding one of the support-member-side connection member and the head-unit-side connection member, the support plate being oriented in a direction that is substantially perpendicular to the acute angle.

6. An ink jet recording device as claimed in claim 1, further comprising:

a first electric connection portion provided to the head unit and that supplies electricity to the head member;

a second electric connection portion provided to the support member and disposed in confrontation with the first electric connection portion; and a horizontal following mechanism for moving the second electric connection portion in the horizontal direction following the horizontal component of the acute angle.

7. An ink jet recording device as claimed in claim 1, wherein the head unit and the support member are provided with a guide mechanism for guiding the head unit onto the support member following the acute angle.

8. An ink jet recording device comprising:

a head unit including:

a head member for ejecting ink; and a head-unit-side connection member formed with a first channel in fluid connection with the head member for supplying ink to the head member; and a support member detachably supporting the head unit, the support member including a support-member-side connection member and a support surface, the support-member-side connection member being formed with a second channel, the support surface extending in a predetermined direction to provide sufficient surface area to support the head unit, wherein, while the support member supports the head unit, the support-member-side connection member and the head-unit-side connection member connected to each other with the second channel and the first channel in fluid communication and extend in a substantial linear relationship at an acute angle with respect to the predetermined direction in which the support surface extends.

9. An ink jet recording device as claimed in claim 8, wherein one of the support-member-side connection member and the head-unit-side connection member includes a male member that protrudes in the acute angle and the other of the support-member-side connection member and the head-unit-side connection member includes a female member opened in the acute angle.

10. An ink jet recording device as claimed in claim 8, wherein the support member is a carriage that moves in a direction substantially perpendicular to a predetermined direction of ink ejection by the head member.

11. An ink jet recording device as claimed in claim 8, wherein the support-member-side connection member and the head-unit-side connection member connect to each other at a location that is higher than the location of the head member.

12. An ink jet recording device as claimed in claim 8, wherein at least one of the head unit and the support member further includes a support plate that supports a corresponding one of the support-member-side connection member and the head-unit-side connection member, the support plate being oriented in a direction that is substantially perpendicular to the acute angle.

13. An ink jet recording device as claimed in claim 8, further comprising:

a first electric connection portion provided to the head unit that supplies electricity to the head member, a second electric connection portion provided to the support member and disposed in confrontation with the first electric connection portion; and a horizontal following mechanism for moving the second electric connection portion in the horizontal direction following the horizontal component of the acute angle.

14. An ink jet recording device as claimed in claim 8, wherein the head unit and the support member are provided with a guide mechanism for guiding the head unit onto the support member following the acute angle.

15. An ink jet recording head comprising:

a head member that ejects ink;

an inlet member provided on the head member and protruding away from the head member in a predetermined direction; and a connection member being in fluid connection with the inlet member and including a portion for connecting with an external ink source to receive ink from the external ink source, the portion straightly extending in a single direction at an acute angle with respect to the predetermined direction in which the inlet member protrudes.

16. An ink jet recording head comprising:

a head member including a nozzle surface extending in a predetermined direction, the nozzle surface being formed with nozzles that eject ink; and a connection member being in fluid connection with the head member and including a portion for connecting with an external ink source to receive ink from the external ink source, the portion straightly extending in a single direction at an acute angle with respect to the predetermined direction in which the nozzle surface extends.

* * * * *